US007408565B2

(12) United States Patent
Takahashi

(10) Patent No.: US 7,408,565 B2
(45) Date of Patent: Aug. 5, 2008

(54) THERMAL ACTIVATION APPARATUS AND PRINTER

(75) Inventor: Masanaori Takahashi, Chiba (JP)

(73) Assignee: Seiko Instruments Inc. (JP)

( * ) Notice: Subject to any disclaimer, the term of this patent is extended or adjusted under 35 U.S.C. 154(b) by 150 days.

(21) Appl. No.: 11/515,811

(22) Filed: Sep. 5, 2006

(65) Prior Publication Data

US 2007/0058029 A1 Mar. 15, 2007

(30) Foreign Application Priority Data

Sep. 12, 2005 (JP) ..... 2005-263881

(51) Int. Cl.
*B41J 2/325* (2006.01)

(52) U.S. Cl. ..... 347/220

(58) Field of Classification Search ..... 347/171, 347/220; 400/662

See application file for complete search history.

(56) References Cited

U.S. PATENT DOCUMENTS 6,243,121 B1 * 6/2001 Agano ..... 347/220

FOREIGN PATENT DOCUMENTS

EP 1052177 11/2000
EP 1369251 12/2003
JP 360162672 A * 8/1985
JP 402139265 A * 5/1990

* cited by examiner

*Primary Examiner*—K. Feggins
(74) *Attorney, Agent, or Firm*—Adams & Wilks

(57) ABSTRACT

A thermal activation apparatus includes a thermal head for thermally activating a heat-sensitive adhesive layer of a heat-sensitive adhesive sheet by heating, and a platen roller for thermal activation opposed to the thermal head for thermal activation. The thermal head for thermal activation is energized by a spring, whereby the platen roller for thermal activation is pressed to the thermal head for thermal activation with a pressure. The heat-sensitive adhesive sheet is heated while being transported between the platen roller for thermal activation and the thermal head for thermal activation, whereby the heat-sensitive adhesive layer is thermally activated. To smoothly transport a heat-sensitive adhesive sheet without stagnating at a position opposed to a thermal head for thermal activation, even in the case where a non-activated portion is present in a heat-sensitive adhesive layer.

8 Claims, 4 Drawing Sheets

A: FRICTIONAL FORCE BETWEEN SURFACE OF THERMAL HEAD AND HEAT-SENSITIVE ADHESIVE LAYER (NON-ACTIVATED PORTION)
B: FRICTIONAL FORCE BETWEEN FLUOROSILICON RUBBER AND RECORDABLE LAYER
C: FRICTIONAL FORCE BETWEEN SURFACE OF THERMAL HEAD AND SHEET-LIKE SUBSTRATE
D: FRICTIONAL FORCE BETWEEN DIMETHYLSILICON RUBBER AND RECORDABLE LAYER

A: FRICTIONAL FORCE BETWEEN SURFACE OF THERMAL HEAD AND HEAT-SENSITIVE ADHESIVE LAYER (NON-ACTIVATED PORTION)
B: FRICTIONAL FORCE BETWEEN FLUOROSILICON RUBBER AND RECORDABLE LAYER
C: FRICTIONAL FORCE BETWEEN SURFACE OF THERMAL HEAD AND SHEET-LIKE SUBSTRATE
D: FRICTIONAL FORCE BETWEEN DIMETHYLSILICON RUBBER AND RECORDABLE LAYER

THERMAL ACTIVATION APPARATUS AND PRINTER

BACKGROUND OF THE INVENTION

1. Field of the Invention

The present invention relates to a thermal activation apparatus for a heat-sensitive adhesive sheet in which a heat-sensitive adhesive layer that usually exhibits non-adhesiveness and exhibits adhesiveness when thermally activated by heating is formed on one surface of a sheet-like substrate, and a printer provided with the thermal activation apparatus.

2. Related Background Art

Up to now, as disclosed in JP 11-79152 A, a heat-sensitive adhesive sheet having a heat-sensitive adhesive layer that exhibits adhesiveness by being heated has been put into practical use. Such a heat-sensitive adhesive sheet has advantages in that the sheet before being heated can be handled easily because there exists no adhesiveness, industrial waste is not produced since a peeling sheet is not required, and the like. In order to exhibit the adhesiveness of the heat-sensitive adhesive layer of the heat-sensitive adhesive sheet, the heat-sensitive adhesive layer may be heated by using a thermal head generally used as a recording head of a thermal printer. Further, in the case where a heat-sensitive recordable layer is provided on a surface of the heat-sensitive adhesive sheet on opposite side of the heat-sensitive adhesive layer, recording and thermal activation can be performed with a similar thermal head.

A platen roller provided so as to be opposed to a thermal head in an ordinary thermal printer is made of dimethylsilicon rubber having a small permanent deformation. The dimethylsilicon rubber has a rubber hardness of about 30 to 60 degrees. In order for the platen roller to support a recording medium as an underlying member during recording, it is preferable that rubber be crushed to some degree, and for this purpose, the platen roller is pressed to the thermal head under a relatively large pressure of 20 gf/mm$^2$ or more. Further, as the rubber hardness is higher, the pressure with which the platen roller is pressed to the thermal head is set to be larger so as to ensure the crushed amount of rubber. The configurations of a thermal head and a platen roller similar to those of such a conventional thermal printer are often used in a thermal activation apparatus without any modification.

A printer has been developed, in which a desired character, number, image, or the like is recorded on a recordable layer of a heat-sensitive adhesive sheet, a heat-sensitive adhesive layer is allowed to exhibit adhesion under the condition that the heat-sensitive adhesive sheet is cut into a predetermined length, and the heat-sensitive adhesive layer is attached to a product, for example, to produce an adhesive label displaying a price, a product name, or the like (see in JP 2003-316265 A, JP 3329246 B and JP 2004-10710). Such a printer includes a recording apparatus for recording a desired character, number, symbol, or image on a recordable layer, and a thermal activation apparatus for thermally activating a heat-sensitive adhesive layer to exhibit adhesion. Such a printer further includes a transport mechanism for transporting a heat-sensitive adhesive sheet, and a cutter mechanism for cutting the heat-sensitive sheet into a desired length to obtain a label. The recording apparatus and the thermal activation apparatus are provided with thermal heads having substantially the same configuration, and platen rollers for supporting and transporting the heat-sensitive adhesive sheet are placed so as to be opposed to the thermal heads, respectively.

In the above-mentioned thermal activation apparatus, it is necessary that a heat-sensitive adhesive sheet is transported by a rotation of a platen roller while adhesion is exhibited by heating a heat-sensitive adhesive layer of the heat-sensitive adhesive sheet by a thermal head. However, in the case where a portion not heated exists in the heat-sensitive adhesive layer of the heat-sensitive adhesive sheet, the friction resistance of a non-heated portion is large, which may cause a transport defect. More specifically, a heated portion, i.e., activated portion, of the heat-sensitive adhesive layer has fluidity immediately after being heated, so that the heated portion can travel smoothly owing to the slipperiness on the surface of the thermal head. However, the non-heated portion, i.e., non-activated portion, has poor slipperiness, and rubs against the surface of the thermal head to cause a defect. For example, in the case where the activated portion and the non-activated portion are arranged in a longitudinal direction, i.e., transport direction, of the heat-sensitive adhesive sheet, the speed of the non-activated portion becomes lower than that of the activated portion, and the non-activated portion stagnates, which is likely to cause skew. Further, in the case where the activated portion and the non-activated portion are arranged in a width direction, i.e., direction orthogonal to the transport direction, of the heat-sensitive adhesive sheet, when the non-activated portion is pressed to the thermal head with pressure, the speed of only that portion becomes lower and that portion stagnates, which is likely to cause jamming. In particular, this tendency becomes remarkable in a high-temperature and high-humidity environment, in which a solidified heat-sensitive adhesive melts.

As described above, the slipperiness of the non-activated portion of the heat-sensitive adhesive layer is poor, and the platen roller idles to cause the stagnation of the heat-sensitive adhesive sheet. This is caused by the larger friction resistance between the non-activated portion and the thermal head than that between a surface, i.e., recordable layer, on an opposite side of the heat-sensitive layer and the platen roller.

In particular, the configuration of the above-mentioned conventional thermal printer is predicated on the transport of a sheet having no heat-sensitive adhesive layer. In the case of using this configuration in the thermal activation apparatus without any modification, a problem of a transport defect of the above-mentioned heat-sensitive adhesive sheet is likely to occur. In other words, irrespective of the magnitude of a pressure with which the platen roller is pressed to the thermal printer, the friction force acting between the non-activated portion of the heat-sensitive adhesive layer and the thermal head over a substantially entire range is larger than the friction force acting between the recordable layer and the dimethylsilicon rubber, of which platen roller is made. Therefore, it is extremely difficult to smoothly transport the non-activated portion of the heat-sensitive adhesive layer without allowing it to stagnate on the surface of the thermal head, by the rotation of the platen roller.

The object of the present invention is to provide a thermal activation apparatus in which a heat-sensitive adhesive sheet having a heat-sensitive adhesive layer on one surface can be transported smoothly without stagnating on the surface of a thermal head, even if a non-activated portion exists in the heat-sensitive adhesive layer, and a printer including the thermal activation apparatus.

SUMMARY OF THE INVENTION

According to the present invention, there is provided a thermal activation apparatus, including: a thermal head for thermally activating a heat-sensitive adhesive layer of a heat-sensitive adhesive sheet in which the heat-sensitive adhesive layer is formed on one surface of a sheet-like substrate by heating; and a platen roller for thermal activation mainly containing fluorosilicon rubber, which is placed opposed to the thermal head for thermal activation, is pressed to the thermal head for thermal activation with a pressure of 5 to 10 $gf/mm^2$, which is relatively smaller than a pressure at which a platen roller for recording is pressed to a thermal head for recording in a conventional thermal printer, i.e., recording apparatus, and allows the heat-sensitive adhesive sheet to travel between the platen roller for thermal activation and the thermal head for thermal activation, thereby transporting the heat-sensitive adhesive sheet.

According to this configuration, the heat-sensitive adhesive layer, in particular, the non-activated portion, of the heat-sensitive adhesive sheet can be prevented from stagnating on the surface of a thermal head for thermal activation, and the heat-sensitive adhesive sheet can be transported smoothly. In particular, even in a high-temperature and high-humidity environment in which a heat-sensitive adhesive melts, the heat-sensitive adhesive sheet can be transported without being stuck. Further, since the heat-sensitive adhesive sheet can be transported smoothly substantially without being influenced by the thermally activated state of the heat-sensitive adhesive layer, even in the case where adhesion is exhibited partially, there is a small possibility that skew occurs.

Further, it is preferable that the platen roller for thermal activation has a surface roughness of ten-point mean roughness Rz of 10 to 15 μm. In this case, when the heat-sensitive adhesive sheet does not exist between the thermal head for thermal activation and the platen roller for thermal activation, the thermal head for thermal activation and the platen roller for thermal activation can be prevented from sticking to each other.

Further, it is preferable that the platen roller for thermal activation has a rubber hardness of 30 to 50 degrees. In this case, the platen roller for thermal activation functions as an appropriate underlying member having an appropriate rubber crushed amount, whereby thermal activation can be satisfactorily performed.

The printer of the present invention includes a thermal activation apparatus with any of the above-mentioned configurations, and a recording apparatus including a thermal head for recording, which records a recordable layer formed on the other surface of a sheet-like substrate by heating and a platen roller for recording, which is placed so as to be opposed to the thermal head for recording and allows a heat-sensitive adhesive sheet to travel between the thermal head for recording and the platen roller for recording.

According to this printer, owing to the thermal head for recording and the platen roller for recording of the recording apparatus, recording and transport can be satisfactorily performed with respect to the recordable layer of the heat-sensitive adhesive sheet.

According to the present invention, the material for the platen roller for thermal activation and the pressure with which the platen roller for thermal activation is pressed to the thermal head for thermal activation can be set appropriately. Therefore, in the thermal activation apparatus, the heat-sensitive adhesive sheet can be transported smoothly without stagnating on the surface of the thermal head for thermal activation.

DETAILED DESCRIPTION OF THE PREFERRED EMBODIMENTS

Hereinafter, an embodiment of the present invention will be described with reference to the accompanying drawings.

Figure 1:
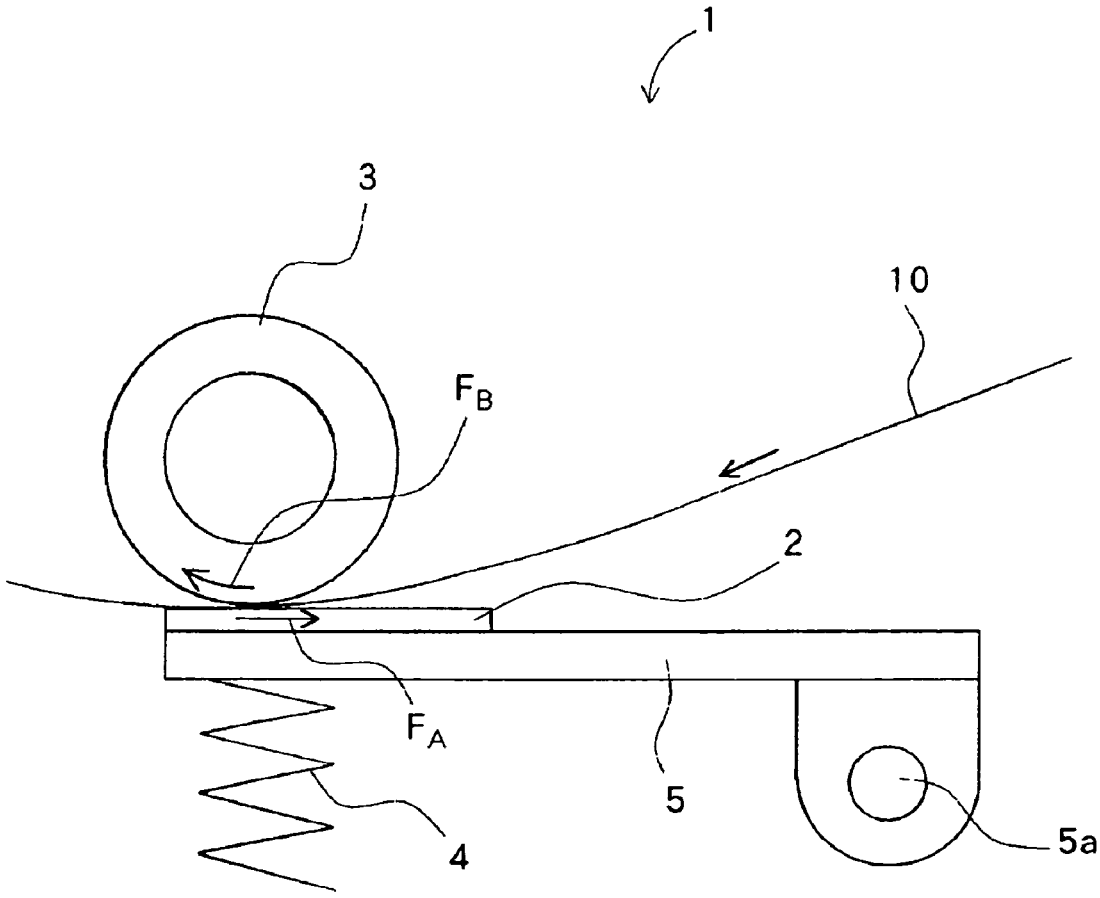
FIG. 1 is an entire structural view showing a thermal activation apparatus of an embodiment of the present invention.

FIG. 1 is a schematic front view showing main portions of a thermal activation apparatus 1 of the present invention. The thermal activation apparatus 1 of this embodiment includes a thermal head 2 for thermal activation having a plurality of heater elements (not shown) arranged so as to form lines in a width direction, a platen roller 3 for thermal activation which is pressed to the thermal head 2 for thermal activation with pressure, and a spring 4. The thermal head 2 for thermal activation is rotatably supported with respect to a shaft 5*a* of a support member 5, and is energized toward the platen roller 3 for thermal activation by the spring 4. Because of this configuration, the platen roller 3 for thermal activation is relatively pressed to the thermal head 2 for thermal activation with a pressure of 5 to 10 $gf/mm^2$.

The thermal head 2 for thermal activation has a configuration similar to that of a recording head of a known thermal printer, such as a configuration in which a protective film of crystallized glass is provided on the surfaces of a plurality of heat elements formed on a ceramic substrate. In this configuration, heating is performed by using a number of small heater elements, i.e., heat elements. Therefore, this configuration has an advantage in that a temperature distribution can be made uniform over a wide range, compared with the configuration in which heating is performed using a single, or a small number of, large heater element. The thermal head 2 for thermal activation is positioned so as to be in contact with the heat-sensitive adhesive layer 10*a* of the heat-sensitive adhesive sheet 10 as shown in FIG. 2.

The platen roller 3 for thermal activation is in contact with the thermal head 2 for thermal activation under a pressure of 5 to 10 $gf/mm^2$, as described above. The platen roller 3 for thermal activation is made of fluorosilicon rubber with a rubber hardness of 30 to 50 degrees, and a surface roughness of a ten-point mean roughness Rz of 10 to 15 μm.

Figure 2:
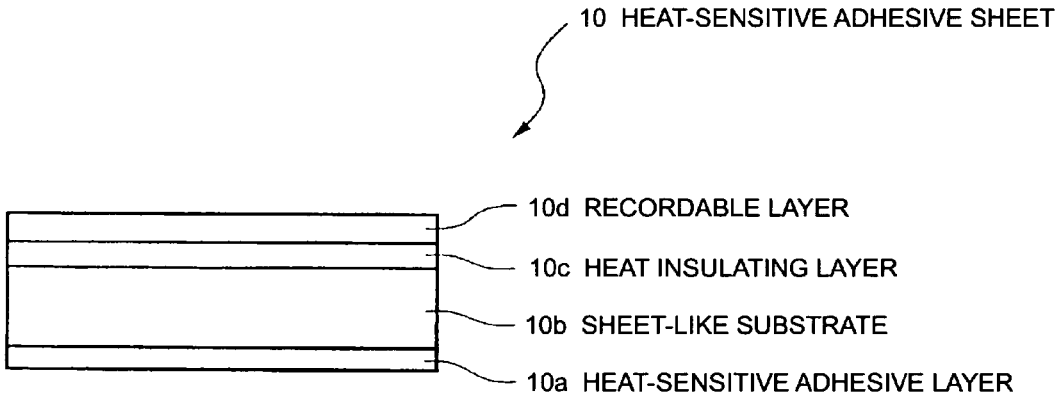
FIG. 2 is an enlarged cross-sectional view showing an example of a heat-sensitive adhesive sheet used in the present invention.

For example, as shown in FIG. 2, the heat-sensitive adhesive sheet 10 used in this embodiment has a configuration in which a heat insulating layer 10*c* and a heat-sensitive coloring layer, i.e., recordable layer, 10*d* are formed on a surface of a sheet-like substrate 10*b*, and the heat-sensitive adhesive layer 10*a* is formed on an opposite surface of the sheet-like substrate 10*b*. The heat-sensitive adhesive layer 10*a* has a configuration in which a heat-sensitive adhesive mainly containing thermoplastic resin, solid plastic resin, or the like is applied, and solidified by drying. However, the heat-sensitive adhesive sheet 10 is not limited to this configuration, and can be variously modified as long as it has the heat-sensitive adhesive layer 10*a*. For example, a configuration in which the heat-sensitive adhesive sheet 10 does not have the heat insulating layer 10*c* can be used. Another configuration of the heat-sensitive adhesive sheet 10 in which a protective layer (not shown) or a colored recording layer, i.e., previously recorded layer (not shown), is provided can be used. Another configuration of the heat-sensitive adhesive sheet 10 in which a thermal coat layer is provided can also be used.

According to the thermal activation apparatus 1 of this embodiment with the above-mentioned configuration, the heat-sensitive adhesive sheet 10 is inserted between the thermal head 2 for thermal activation and the platen roller 3 for thermal activation, and the thermal head 2 for thermal activation is operated to generate heat while the heat-sensitive adhesive sheet 10 is pressed to the thermal head 2 for thermal activation with pressure by the platen roller 3 for thermal activation, whereby the heat-sensitive adhesive layer 10*a* which is in contact with the thermal head 2 for thermal activation is heated to be thermally activated. Simultaneously, the platen roller 3 for thermal activation rotates to transport the heat-sensitive adhesive sheet 10, and the heat-sensitive adhesive layer 10*a* travels while being in contact with the thermal head 2 for thermal activation, whereby adhesion can be exhibited on the heat-sensitive adhesive layer 10*a* on one surface of the heat-sensitive adhesive sheet 10 over the entire length.

Figure 3:
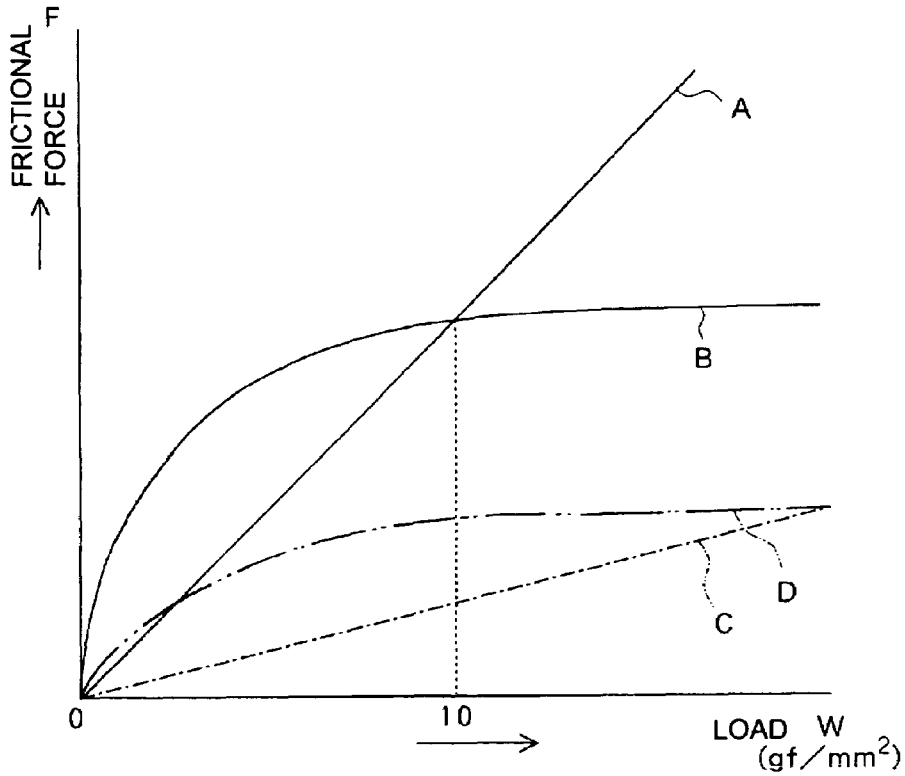
FIG. 3 is a graph showing a relationship between a load and a friction force in various combinations of a thermal head or a platen roller and a sheet material.

Thus, when the heat-sensitive adhesive sheet 10 is transported while adhesion is exhibited on the heat-sensitive adhesive layer 10*a*, even if a non-heated portion, i.e., a non-activated portion, exists in the heat-sensitive adhesive layer 10*a*, in this embodiment, the non-activated portion of the heat-sensitive adhesive layer 10*a* does not stagnate on the surface of the thermal head 2 for thermal activation due to decrease in speed, and the heat-sensitive adhesive sheet 10 can be transported smoothly. The description of this configuration will be made below. The platen roller 3 for thermal activation of this embodiment is made of fluorosilicon rubber having a friction coefficient larger than that of dimethylsilicon rubber and having adhesion smaller than that of fluorine rubber. Then, as described above, the thermal head 2 for thermal activation is energized toward the platen roller 3 for thermal activation by the spring 4 as described above, and the platen roller 3 for thermal activation is relatively pressed to the thermal head 2 for thermal activation with a pressure of 5 to 10 gf/mm$^2$ Consequently, a frictional force $F_B$ between the recordable layer 10*d* and the platen roller 3 for thermal activation becomes larger than a frictional force $F_A$ between the non-activated portion of the heat-sensitive adhesive layer 10*a* and the thermal head 2 for thermal activation. A graph shown in FIG. 3 shows a specific example thereof. In this graph, a horizontal axis represents a load W, that is, pressure with which two members are pressed to each other, and a vertical axis represents frictional force F between two members. In general, frictional force between rigid bodies (e.g., a thermal head and a sheet material) is represented by F=kW (in this case, k is a friction coefficient), and friction force between rubber and rigid body (e.g., a platen roller made of rubber and a sheet material) is represented by $F=kW^{2/3}$. Regarding the load W, in the case of this embodiment, the thin heat-sensitive adhesive sheet 10 does not change the magnitude of a pressure, so that the load W may be considered to be equal to the pressure with which the platen roller is pressed to the thermal head.

In the case of an example shown in FIG. 3, when the pressure W with which the platen roller 3 for thermal activation is pressed to the thermal head 2 for thermal activation is substantially equal to or lower than 10 gf/mm$^2$, the frictional force $F_B$ represented by a line B between the platen roller 3 for thermal activation made of fluorosilicon rubber and the recordable layer 10*d* becomes larger than the frictional force $F_A$ represented by a line A between the non-activated portion of the heat-sensitive adhesive layer 10*a* and the thermal head 2 for thermal activation. On the other hand, when the pressure is larger than 10 gf/mm$^2$, the frictional force $F_B$ represented by a line B between the recordable layer 10*d* and the platen roller 3 for thermal activation becomes smaller than the frictional force $F_A$ represented by a line A between the non-activated portion of the heat-sensitive adhesive layer 10*a* and the thermal head 2 for thermal activation. According to this embodiment, the platen roller 3 for thermal activation made of fluorosilicon rubber is pressed to the thermal head 2 for thermal activation with a pressure of 10 gf/mm$^2$ or less. Therefore, when the heat-sensitive adhesive sheet 10 is transported under the condition of being inserted between the thermal head 2 for thermal activation and the platen roller 3 for thermal activation, irrespective of the frictional force $F_A$ between the non-activated portion of the heat-sensitive adhesive layer 10*a* and the thermal head 2 for thermal activation which is relatively large, the heat-sensitive adhesive sheet 10 is traveled by the platen roller 3 for thermal activation by the force $F_B$ stronger than the frictional force $F_A$. Thus, the heat-sensitive adhesive sheet 10 travels smoothly along the platen roller 3 for thermal activation without causing a transport defect. It should be noted that the graph in FIG. 3 shows an example, and is considered to vary depending on various conditions such as the surface roughness, rubber hardness, and the like of the platen roller described later other than the pressure. Therefore, it is considered that the border point of a magnitude of the frictional force varies from 10 gf/mm$^2$ depending upon the conditions at each time.

The graph in FIG. 3 shows a frictional force represented by a line D between dimethylsilicon rubber serving as a material for a general platen roller in a thermal printer and a recordable layer, for comparison. Referring to this graph, in the case of using a platen roller made of dimethylsilicon rubber as in a conventional thermal printer, in an almost every range of the load W, the frictional force represented by a line A between the heat-sensitive adhesive layer and the thermal head for thermal activation is larger than the frictional force represented by a line D between the platen roller for thermal activation made of dimethylsilicon rubber and the recordable layer. When the pressure with which the platen roller for thermal activation is pressed to the thermal head for thermal activation is extremely small, there exists a region where the frictional force represented by a line A between the heat-sensitive adhesive layer and the thermal head for thermal activation is smaller than the frictional force represented by a line D between the platen roller for thermal activation made of dimethylsilicon rubber and the recordable layer. However, it is not practical that this pressure is smaller than 5 gf/mm$^2$, because the platen roller does not function sufficiently as an underlying member during thermal activation of the heat-sensitive adhesive layer, with the result that satisfactory thermal activation cannot be performed. Thus, even if the platen roller for thermal activation rotates, the platen roller idles, and the non-activated portion of the heat-sensitive adhesive layer stagnates on the surface of the thermal head for thermal activation, causing a transport defect. In contrast, in this embodiment, as described above, by using the platen roller 3 for thermal activation made of fluorosilicon rubber, and setting the pressure with which the platen roller 3 for thermal activation is pressed to the thermal head 2 for thermal activation to be 5 to 10 gf/mm$^2$, a problem of such a transport defect occurring in the case of using the platen roller for thermal activation made of dimethylsilicon rubber is solved.

The platen roller 3 for thermal activation of this embodiment has a surface roughness of a ten-point mean roughness Rz of 10 to 15 μm. The range of this surface roughness is the experimental result of the condition capable of preventing the platen roller 3 for thermal activation made of fluorosilicon rubber having a large friction coefficient from sticking to the thermal head 2 for thermal activation in the absence of the heat-sensitive adhesive sheet 10 therebetween, allowing the heat-sensitive adhesive sheet 10 to be transported smoothly on the thermal head 2 for thermal activation, and suppressing the stickiness to such a degree that the heat-sensitive adhesive sheet 10 can easily peel from the platen roller 3 for thermal activation to be transported smoothly to a downstream side thereof.

Further, the platen roller 3 for thermal activation of this embodiment has a rubber hardness of 30 to 50 degrees. This rubber hardness is relatively small among fluorosilicon rubber, and owing to this, when the pressure with which the platen roller 3 for thermal activation is pressed to the thermal head 2 for thermal activation is 5 to 10 gf/mm$^2$, the platen roller 3 for thermal activation functions as an underlying member during thermal activation so as to ensure an appropriately rubber crushing amount and to realize a sufficient nip width to avoid active streaking, whereby satisfactory thermal activation can be performed.

Next, a printer incorporating the thermal activation apparatus 1 of the present invention described above will be described with reference to FIG. 4.

The basic configuration of a printer for a heat-sensitive adhesive sheet shown in FIG. 4 will be described briefly. The printer for a heat-sensitive adhesive sheet includes a roll accommodating mechanism 13 for holding the heat-sensitive adhesive sheet 10 wound in a roll shape, a recording apparatus 14 for recording the recordable layer 10*d* shown in FIG. 2 of the heat-sensitive adhesive sheet 10, a cutter mechanism 15 for cutting the heat-sensitive adhesive sheet 10 into a predetermined length, and the thermal activation apparatus 1 with the above-mentioned configuration shown in FIG. 1, for thermally activating the heat-sensitive adhesive layer 10*a* shown in FIG. 2 of the heat-sensitive adhesive sheet 10. It should be noted that the illustrated direction of the thermal activation apparatus 1 is different between FIGS. 1 and 4

The roll accommodating mechanism 13 holds a roll body of the heat-sensitive adhesive sheet 10 rotatably.

Figure 4:
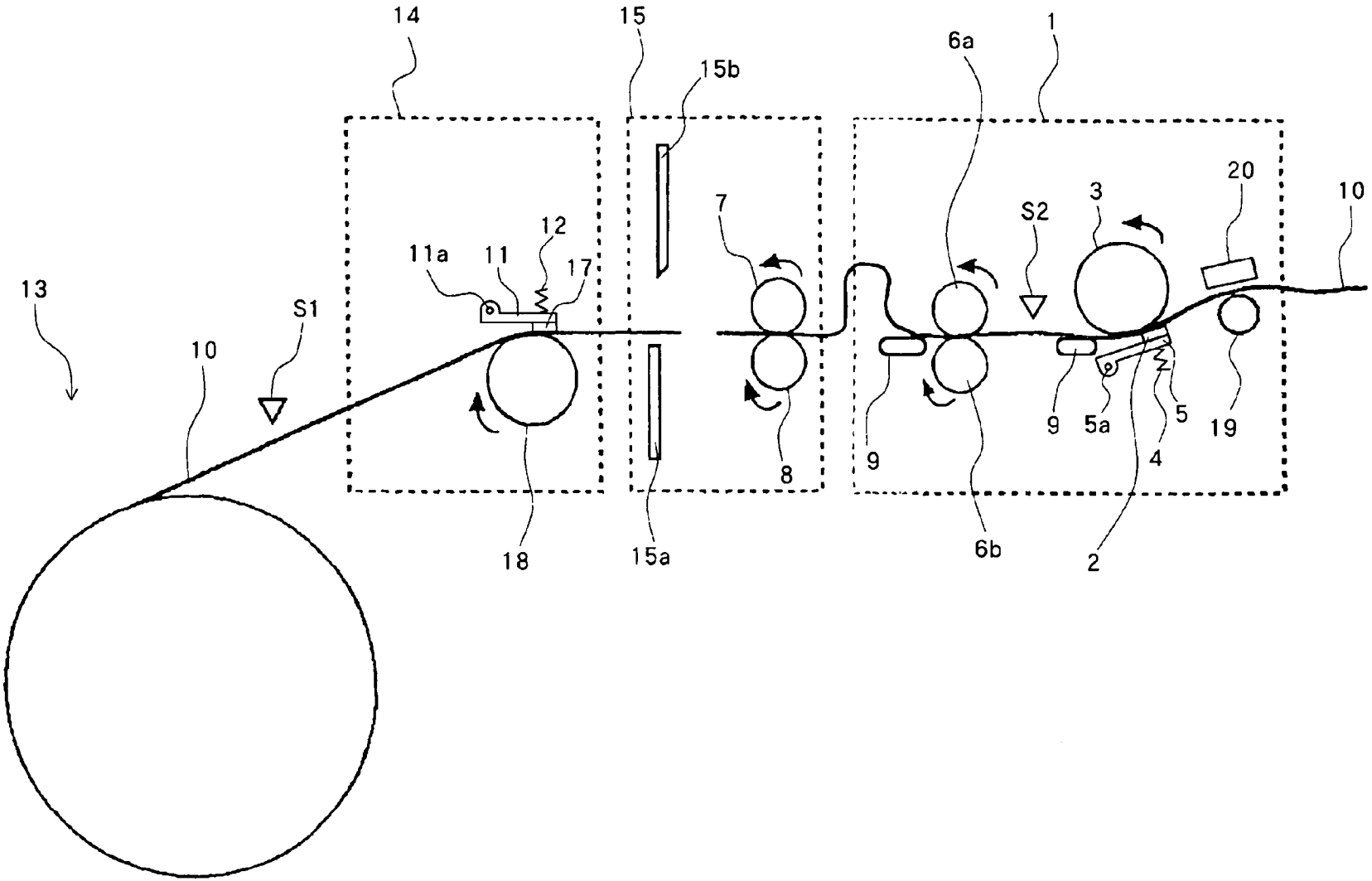
FIG. 4 is an entire structural view showing a printer including the thermal activation apparatus shown in FIG. 1.

The recording apparatus 14 includes a thermal head 17 for recording having a plurality of heater elements made of relatively small resistors, arranged in a width direction, i.e., direction vertical to FIG. 4, so that dot recording can be performed, and a platen roller 18 for recording pressed to the thermal head 17 for recording with pressure. The thermal head 17 for recording is positioned so as to be in contact with the recordable layer 10*d* of the heat-sensitive adhesive sheet 10 sent from the roll accommodating mechanism 13, is rotatably supported with respect to a shaft 11*a* of a support member 11, and biased toward the platen roller 18 for recording by a spring 12. Owing to this configuration, the platen roller 18 for recording is pressed to the thermal head 17 for recording with pressure. The thermal head 17 for recording has a configuration similar to that of the thermal head 2 for thermal activation of the thermal activation apparatus 1, that is, a configuration similar to that of a recording head of a known thermal printer, such as a configuration in which a protective film of crystallized glass is provided on surfaces of a plurality of heat elements formed on a ceramic substrate. Thus, by configuring the thermal head 17 for recording in the same way as in the thermal head 2 for thermal activation, common components can be used to reduce a cost.

The platen roller 18 for recording of this embodiment is made of dimethylsilicon rubber with a rubber hardness of about 30 to 40 degrees, and is pressed to the thermal head 17 for recording with a pressure of 20 gf/mm$^2$ or more. Further, the heat-sensitive adhesive layer 10*d* that is not activated is not pressed to the thermal head 17 for recording with pressure, but is pressed to the platen roller 18 for recording with pressure and moves in synchronization with the rotation thereof. Therefore, owing to this configuration, satisfactory recording and satisfactory transport of the heat-sensitive adhesive sheet 10 can be performed in a similar manner to that of a general thermal printer.

The cutter mechanism 15 cuts the heat-sensitive adhesive sheet 10, on which recording is performed by the recording apparatus 14, into a predetermined length to form a label, and includes a movable blade 15*b* that is operated by a driving source (not shown) such as an electric motor, a fixed blade 15*a* opposed to the movable blade 15*b*, and the like. Further, the cutter mechanism 15 is provided with a pair of delivery rollers 7 and 8 for discharging the heat-sensitive adhesive sheet 10 from the cutter mechanism 15, in addition to a pair of blades 15*a* and 15*b*. The heat-sensitive adhesive sheet 10 is sent to the thermal activation apparatus 1 in a latter stage while being sandwiched between the delivery rollers 7 and 8. The heat-sensitive adhesive sheet 10 may be sent from the cutter mechanism 15 to the thermal activation apparatus 1, by using the transportation force of the platen roller 18 for recording of the recording apparatus 14, without providing the delivery rollers 7 and 8.

The thermal activation apparatus 1 is provided on a downstream side of the cutter mechanism 15. The thermal activation apparatus 1 includes the thermal head 2 for thermal activation, the platen roller 3 for thermal activation, the support member 5, the spring 4, and the insertion rollers 6*a* and 6*b*. Further, the thermal activation apparatus 1 is provided with a discharge roller 19 and a discharge guide 20 for discharging the heat-sensitive adhesive sheet 10 having traveled between the thermal head 2 for thermal activation and the platen roller 3 for thermal activation to the outside of the printer.

There is provided a configuration capable of loosening the heat-sensitive adhesive sheet 10 between the delivery rollers 7 and 8 of the cutter mechanism 15 and the insertion rollers 6*a* and 6*b* of the thermal activation apparatus 1 by adjusting the rotations of the delivery rollers 7 and 8 and the insertion rollers 6*a* and 6*b*. In view of this configuration, description will be made. When the heat-sensitive adhesive sheet 10 is cut with the blades 15*a* and 15*b*, if a portion to be cut is not stopped, a cutting operation cannot be performed. In other words, the traveling heat-sensitive adhesive sheet 10 cannot be cut smoothly with the blades 15*a* and 15*b*. On the other hand, when the transportation of the entire heat-sensitive adhesive sheet 10 is halted, the heat-sensitive adhesive layer 10*a* thermally activated in the thermal activation apparatus 1 adheres to the thermal head 2 for thermal activation in a halted state and cannot travel. Thus, when the heat-sensitive adhesive sheet 10 is located at a position opposed to the thermal head 2 for thermal activation, the heat-sensitive adhesive sheet 10 needs to be continuously traveled at a speed in which the heat-sensitive adhesive layer 10*a* does not adhere to the thermal head 2 for thermal activation. On the other hand, when a portion to be cut of the thermal head 2 for thermal activation reaches a position opposed to the blades 15*a* and 15*b*, it is necessary to suspend the traveling to cut the portion.

Prior to the thermal activation, at a time when the front end of the heat-sensitive adhesive sheet 10 has not reached the thermal head 2 for thermal activation, the rotation of the insertion rollers 6*a* and 6*b* is set to be slower than that of the delivery rollers 7 and 8, whereby the heat-sensitive adhesive sheet 10 is loosened between the insertion rollers 6*a* and 6*b* and the delivery rollers 7 and 8. By operating so, the heat-sensitive adhesive sheet 10 can be continuously transported in the thermal activation apparatus 1 without being halted, while operation of the heat-sensitive adhesive sheet 10 is partially suspended at a position opposed to the blades 15*a* and 15*b*. To be specific, a loosened portion is formed by presetting the difference in rotation speed between the delivery rollers 7 and 8 and the insertion rollers 6*a* and 6*b*, and then, the insertion rollers 6*a* and 6*b* are rotated at an ordinary rotation speed, whereby thermal activation processing is performed with the thermal activation apparatus 1 on a downstream side of the insertion rollers 6*a* and 6*b*. In the course of this, when the position to be cut of the heat-sensitive adhesive sheet 10 reaches the position opposed to the blades 15*a* and 15*b*, the operation of the delivery rollers 7 and 8 are suspended and cut smoothly with the blades 15*a* and 15*b*. At this time, although the delivery rollers 7 and 8 are still, a portion of the heat-sensitive adhesive sheet 10 on a downstream side of the insertion rollers 6*a* and 6*b* can continuously travel only by the loosened portion. By operating so, a predetermined portion of the heat-sensitive adhesive sheet 10 can be cut smoothly with the cutter mechanism 15 while the heat-sensitive adhesive sheet 10 is prevented from becoming unable to travel by adhering to the thermal head 2 for thermal activation. The magnitude of the looseness is set to such a degree that the cutting is completed and the rotation of the delivery rollers 7 and 8 is restarted to rotate concurrently with the insertion rollers 6*a* and 6*b*, before the looseness is completely eliminated. The guide member 9 functions to regulate the loosening direction, and to allow the heat-sensitive adhesive sheet 10 to smoothly travel from the loosened portion to the insertion rollers 6*a* and 6*b*.

In the above description, the loosened portion is formed by previously setting the difference in rotation speed between the delivery rollers 7 and 8 and the insertion rollers 6*a* and 6*b*. However, the loosened portion can also be formed by suspending operation of the insertion rollers 6*a* and 6*b* at a time when the front end of the heat-sensitive adhesive sheet 10 has not reached the thermal head 2 for thermal activation. In any case, by previously forming a loosened portion, at a time when the position to be cut of the heat-sensitive adhesive sheet 10 reaches a position opposed to the blades 15*a* and 15*b*, the operation of the delivery rollers 7 and 8 is suspended immediately and cutting can be performed with the blades 15*a* and 15*b*. The timing of this cutting can be set freely irrespective of the thermal activation operation and the like.

Further, the printer is provided with detectors S1 and S2 such as optical sensors for detecting the presence/absence of the heat-sensitive adhesive sheet 10 at an inlet of the recording apparatus 14 and before the thermal head 2 for thermal activation of the thermal activation apparatus 1. Further, although not shown, the printer has a control apparatus that is capable of transmitting/receiving a signal with respect to the detectors S1 and S2; drives the respective rollers 3, 6*a*, 6*b*, 7, 8, 18, and 19 constituting the transport mechanism, the movable blade 15*b*, the thermal head 17 for recording, the thermal head 2 for thermal activation, and the like; and controls the operations thereof.

A method of producing a desired adhesive label made of the heat-sensitive adhesive sheet 10, by using the printer with the above-mentioned configuration, will be described.

First, the heat-sensitive adhesive sheet 10 pulled out from the roll accommodating mechanism 13 is inserted between the thermal head 17 for recording and the platen roller 18 for recording of the recording apparatus 14. A recording signal is supplied from the control apparatus to the thermal head 17 for recording, and a plurality of heater elements of the thermal head 17 for recording are selectively driven at an appropriate timing to generate heat, whereby recording is performed on the recordable layer 10*d* of the heat-sensitive adhesive sheet 10. The platen roller 18 for recording is driven to rotate in synchronization with the driving of the thermal head 17 for recording, and the heat-sensitive adhesive sheet 10 is transported in a direction orthogonal to a direction in which the heater elements of the thermal head 17 for recording are arranged, e.g., in a direction vertical to the lines of the heater elements. To be specific, the recording of one line by the thermal head 17 for recording and the transportation of a predetermined amount corresponding to one line of the heat-sensitive adhesive sheet 10 by the platen roller 18 for recording are repeated alternately, whereby a desired character, number, symbol, image, and the like are recorded on the heat-sensitive adhesive sheet 10.

The heat-sensitive adhesive sheet 10 thus recorded travels between the movable blade 15*b* and the fixed blade 15*a* of the cutter mechanism 15 to reach the delivery rollers 7 and 8. Then, as described above, at a time when the front end of the heat-sensitive adhesive sheet 10 has not reached the thermal head 2 for thermal activation, by suspending the operation of the insertion rollers 6*a* and 6*b* of the thermal activation apparatus. 1, or reducing the speed thereof compared to that of the operation of the delivery rollers 7 and 8, the heat-sensitive adhesive sheet 10 is loosened by a required amount.

Next, the heat-sensitive adhesive sheet 10, on which required recording has been performed as described above, is sent to the thermal activation apparatus 1 by rotating the insertion rollers 6*a* and 6*b*. Then, in the thermal activation apparatus 1, the control apparatus drives the thermal head 2 for thermal activation with the heat-sensitive adhesive sheet 10 sandwiched between the thermal head 2 for thermal activation and the platen roller 3 for thermal activation, and the heat-sensitive adhesive layer 10*a* in contact with the thermal head 2 for thermal activation is heated to be thermally activated. Concurrently, the platen roller 3 for thermal activation is rotated to send the heat-sensitive adhesive sheet 10, and the heat-sensitive adhesive sheet 10 is allowed to travel while the entire surface of the heat-sensitive adhesive layer 10*a* being in contact with the thermal head 2 for thermal activation.

When the position to be cut of the heat-sensitive adhesive sheet 10 has reached the position opposed to the blades 15*a* and 15*b* while the heat-sensitive adhesive sheet 10 is being transported and thermally activated, operation of the delivery rollers 7 and 8 are halted immediately and cutting by the blades 15*a* and 15*b* is performed. At this time, the insertion rollers 6*a* and 6*b* continue to rotate, and a portion of the heat-sensitive adhesive sheet 10 on a downstream side of the delivery rollers 7 and 8 continues to travel without halting while gradually eliminating the loosened portion.

Thus, desired recording is performed on one surface and adhesiveness is exhibited on the opposite surface, whereby an adhesive label made of the heat-sensitive adhesive sheet 10 cut into a predetermined length is completed.

The printer of this embodiment adopts a configuration, that is not used conventionally, in which a material and a contact pressure are varied respectively by the platen roller 18 for recording of the recording apparatus 14 and the platen roller 3 for thermal activation of the thermal activation apparatus 1. Therefore, owing to the thermal head 17 for recording and the platen roller 18 for recording of the recording apparatus 14, satisfactory recording and satisfactory transport of the heat-sensitive adhesive sheet 10 can be realized. Also, as described above, the platen roller 3 for thermal activation of the thermal activation apparatus 1 functions as a satisfactory underlying member with an appropriate rubber crushing amount, whereby satisfactory thermal activation can be performed. Further, even if a non-activated portion is present in the heat-sensitive adhesive layer of the heat-sensitive adhesive sheet 10, the heat-sensitive adhesive sheet 10 can be transported smoothly at a speed corresponding to the rotation of the insertion rollers 6*a* and 6*b* and the platen roller 3 for thermal activation while suppressing the occurrence of transport defects such as skew and jamming, without stagnating at a position opposed to the thermal head 2 for thermal activation.

What is claimed is:

1. A thermal activation apparatus, comprising:

a thermal head for thermally activating a heat-sensitive adhesive layer of a heat-sensitive adhesive sheet, the heat-sensitive adhesive sheet having the heat-sensitive adhesive layer to activate by heating on one surface of a sheet-like substrate; and a platen roller for thermal activation mainly containing fluorosilicon rubber, which is arranged to be opposed to the thermal head for thermal activation, is pressed to the thermal head for thermal activation with a pressure of 5 to 10 gf/mm$^2$, for conveying the heat-sensitive adhesive sheet between the platen roller and the thermal head to transport the heat-sensitive adhesive sheet.

2. The thermal activation apparatus according to claim 1, wherein the platen roller for thermal activation has a surface roughness of ten-point mean roughness Rz of 10 to 15 μm.

3. The thermal activation apparatus according to claim 2, wherein the platen roller for thermal activation has a rubber hardness of 30 to 50 degrees.

4. A printer comprising:

the thermal activation apparatus of claim 3; and a recording apparatus including a thermal head for recording a recordable layer to activate by heating on the other surface of the sheet-like substrate, and a platen roller for recording being arranged to be opposed to the thermal head, for conveying the heat-sensitive adhesive sheet between the platen roller for recording and the thermal head for recording thereby.

5. A printer comprising:

the thermal activation apparatus of claim 2; and a recording apparatus including a thermal head for recording a recordable layer to activate by heating on the other surface of the sheet-like substrate, and a platen roller for recording being arranged to be opposed to the thermal head, for conveying the heat-sensitive adhesive sheet between the platen roller for recording and the thermal head for recording thereby.

6. The thermal activation apparatus according to claim 1, wherein the platen roller for thermal activation has a rubber hardness of 30 to 50 degrees.

7. A printer comprising:

the thermal activation apparatus of claim 6; and a recording apparatus including a thermal head for recording a recordable layer to activate by heating on the other surface of the sheet-like substrate, and a platen roller for recording being arranged to be opposed to the thermal head, for conveying the heat-sensitive adhesive sheet between the platen roller for recording and the thermal head for recording thereby.

8. A printer comprising:

the thermal activation apparatus of claim 1; and a recording apparatus including a thermal head for recording a recordable layer to activate by heating on the other surface of the sheet-like substrate, and a platen roller for recording being arranged to be opposed to the thermal head, for conveying the heat-sensitive adhesive sheet between the platen roller for recording and the thermal head for recording thereby.

* * * * *